US006584943B1

(12) United States Patent
Klotz

(10) Patent No.: US 6,584,943 B1
(45) Date of Patent: Jul. 1, 2003

(54) VARIABLE COMPOUND ROCKER SYSTEM FOR PUSH ROD AND OVERHEAD CAMSHAFT ENGINES

(75) Inventor: James R Klotz, Mt. Clemens, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 17 days.

(21) Appl. No.: 10/246,138

(22) Filed: Sep. 18, 2002

(51) Int. Cl.[7] ..... F01L 1/34

(52) U.S. Cl. ..... 123/90.16; 123/90.31; 123/90.39; 123/90.61; 74/569

(58) Field of Search ..... 123/90.16, 90.24, 123/90.31, 90.6, 90.39, 90.4, 90.41, 90.44, 90.61, 90.62, 90.63, 90.64

(56) References Cited

U.S. PATENT DOCUMENTS 5,560,329 A * 10/1996 Hayman ..... 123/90.31
6,041,746 A * 3/2000 Takemura et al. ..... 123/90.16
6,055,949 A * 5/2000 Nakamura et al. ..... 123/90.16
6,123,053 A * 9/2000 Hara et al. ..... 123/90.16
6,354,255 B1 * 3/2002 Methley et al. ..... 123/90.16
6,422,187 B2 * 7/2002 Fischer et al. ..... 123/90.16
6,439,178 B1 * 8/2002 Pierik ..... 123/90.16
6,497,206 B2 * 12/2002 Nohara et al. ..... 123/90.16

FOREIGN PATENT DOCUMENTS

EP 717174 A1 * 6/1996 ..... F01L/13/00

* cited by examiner

*Primary Examiner*—Thomas Denion
*Assistant Examiner*—Ching Chang

(57) ABSTRACT

A variable compound rocker system for varying the lift of intake valves of an internal combustion engine is provided. The system comprises a rocker shaft with eccentric rings non-rotatably attached thereto. Furthermore, the system includes primary rockers non-rotatably attached to the eccentric rings. The primary rockers have engaging surfaces for engaging rollers attached to secondary rockers. The rollers enable the primary rockers to actuate the secondary rockers, thus actuating the intake valves. The system further includes an actuator assembly adapted to incrementally rotate the rocker shaft, and thus the primary rockers. This incremental rotation of primary rockers changes their attitude causing the lift of the intake valves to vary, thus varying the engine performance characteristics.

16 Claims, 3 Drawing Sheets

VARIABLE COMPOUND ROCKER SYSTEM FOR PUSH ROD AND OVERHEAD CAMSHAFT ENGINES

FIELD OF THE INVENTION

The present invention relates to a rocker system for push rod and overhead camshaft engines, more particularly to a variable compound rocker system having primary and secondary rocker assemblies adapted for varying valve lift.

BACKGROUND OF THE INVENTION

Traditional push rod internal combustion engines include a single camshaft disposed in the valley of the engine block for actuating the intake and exhaust valves via pushrods and rockers that pivot about a rocker shaft. A disadvantage of this design, however, is that no convenient method for varying the lift of the intake valves exists. It is desirable to vary the lift of the intake valves to increase engine performance in certain applications. For example, during start-up it would be advantageous to lower the lift of the intake valves to help decrease fuel emissions and improve fuel economy. Similarly, at high cruising speeds it would be advantageous to increase the lift of the intake valves to increase performance. Hence, a rocker system capable of varying the lift of the intake valves in an internal combustion engine is desired. Such systems are disclosed in U.S. Pat. No. 5,560,329, U.S. Pat. No. 6,041,746, U.S. Pat. No. 6,055,949, and U.S. Pat. No. 6,123,053.

Each of these patents however, disclose or suggest a system of cams and linkages moving in sequence to vary the intake valve lift events. A disadvantage apparent to these configurations is the need for many moving parts, which increases the risk of failure. Another disadvantage of these systems is the loss of energy due to frictional and rotational resistances apparent in such complex configurations. A further disadvantage to these systems is the need for very particular assembly procedures, which lacks economic efficiency.

Thus, a simplified variable compound rocker system that is fully contained within the cylinder head is desired. This ensures compactness of the engine block, easy adaptation to current production push rod and overhead camshaft engines, and minimal energy losses due to friction and gyro dynamics.

SUMMARY OF THE INVENTION

The present invention provides a compound rocker system for varying the lift of intake valves adaptable for push rod and overhead camshaft internal combustion engines for use in motor vehicles. The rocker system includes a rocker shaft, a plurality of primary rockers positioned on a plurality of eccentric rings, a plurality of secondary rockers, and a plurality of exhaust rockers, all positioned on the rocker shaft. The primary rockers are adapted to actuate the secondary rockers, and the secondary rockers are adapted to actuate the intake valves. Furthermore, an actuator assembly is adapted to incrementally rotate the rocker shaft, thus changing the attitude of the primary rockers causing a variance in the lift of the intake valves. This allows for increased performance in different applications.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
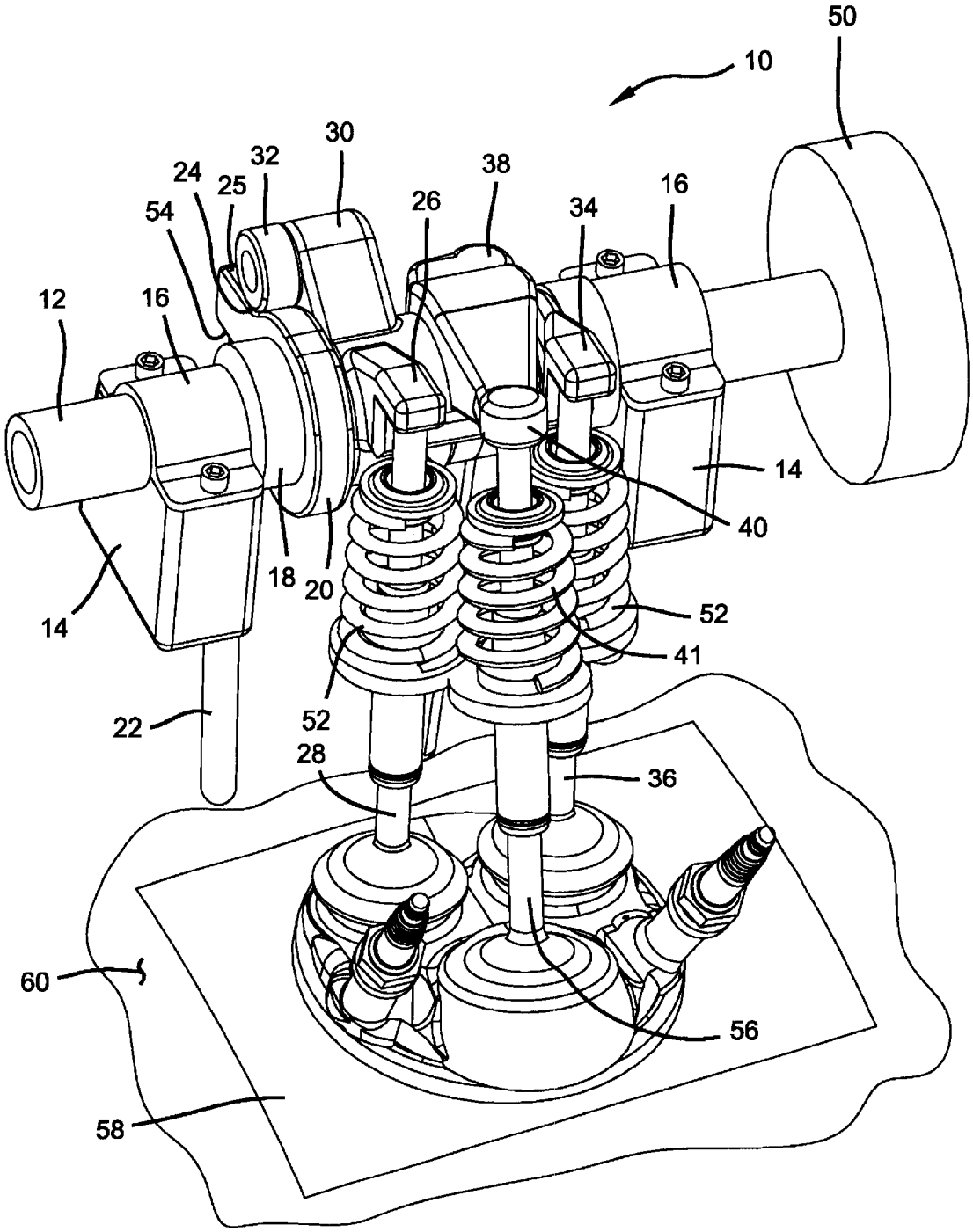
FIG. 1 is an isometric view of a preferred embodiment of the present invention.
Figure 2:
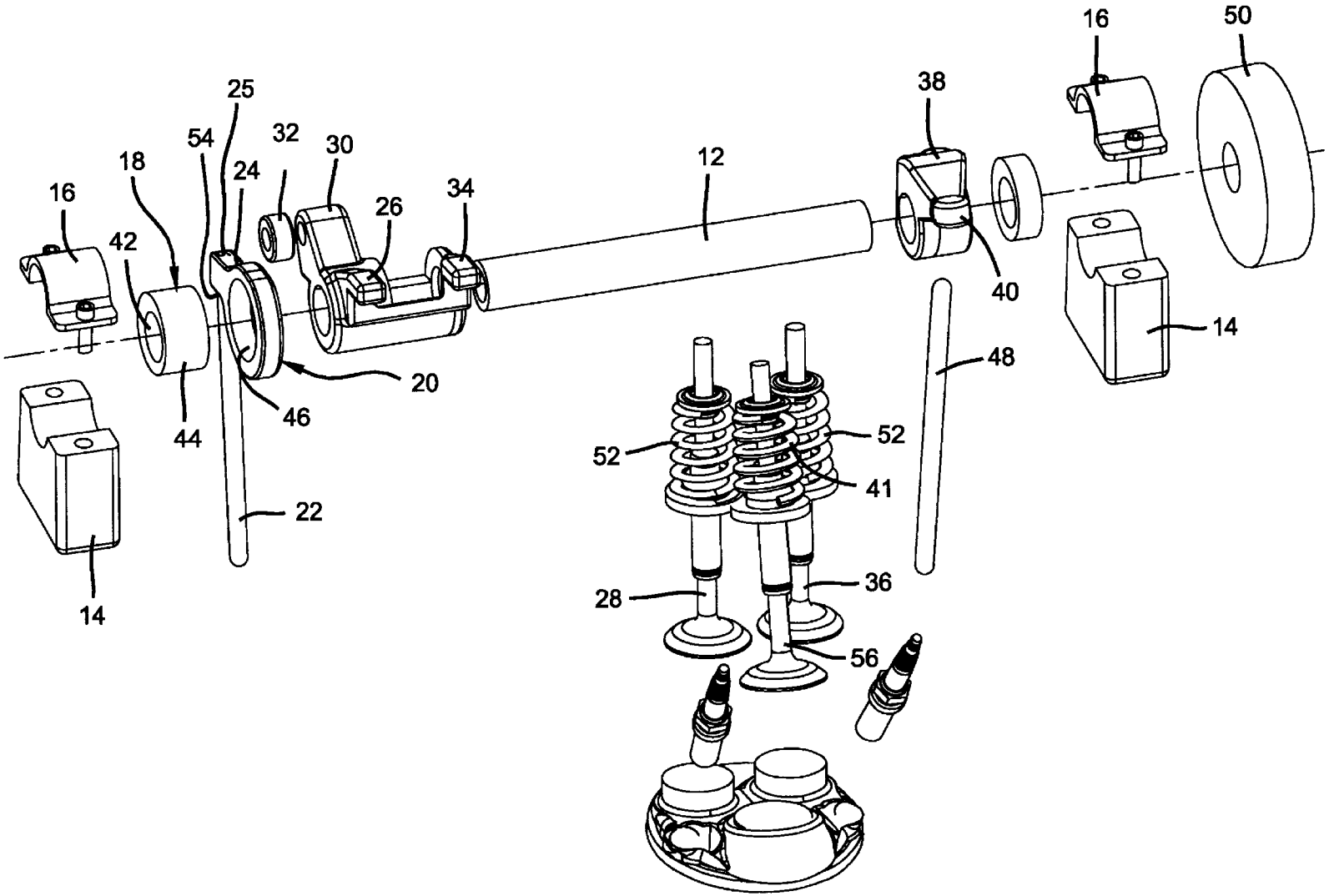
FIG. 2 is an exploded view of a preferred embodiment of the present invention.

Referring to FIGS. 1 and 2, a preferred embodiment of the variable compound rocker system 10 of the present invention is shown in isometric view and in exploded view, respectively, as adapted to an internal combustion engine 58 for use in a motor vehicle 60. The variable compound rocker system 10 includes a rocker shaft 12 having an axis of rotation, whereby the rocker shaft 12 is rotatably supported on a plurality of cylinder head pedestals 14 and contained thereon by a plurality of rocker caps 16. An eccentric ring 18 is also provided having an axis of rotation, an interior surface 42, and an exterior surface 44 non-rotatably attached to the rocker shaft 12. It should be appreciated that the eccentric ring 18 could be directly formed as part of the rocker shaft 12, or as illustrated in FIG. 2, it could be assembled to the rocker shaft 12 by weld, press fit, pin, or other mechanical fastening means.

Further included in the system 10 is a primary rocker 20 having an interior surface 46 rotatably attached to the exterior surface 44 of the eccentric ring 18. The primary rocker 20 includes a socket surface 54 for receiving an intake pushrod 22 and an engaging surface 24 for engaging a roller 32. A secondary rocker 30 is positioned generally adjacent to the primary rocker 20 and includes a roller 32 in constant sliding engagement with the engaging surface 24 of the primary rocker 20. The secondary rocker 30 further includes a first valve arm 26 in constant driving engagement with a first intake valve 28 and a second valve arm 34 in constant driving engagement with a second intake valve 36.

Figure 3:
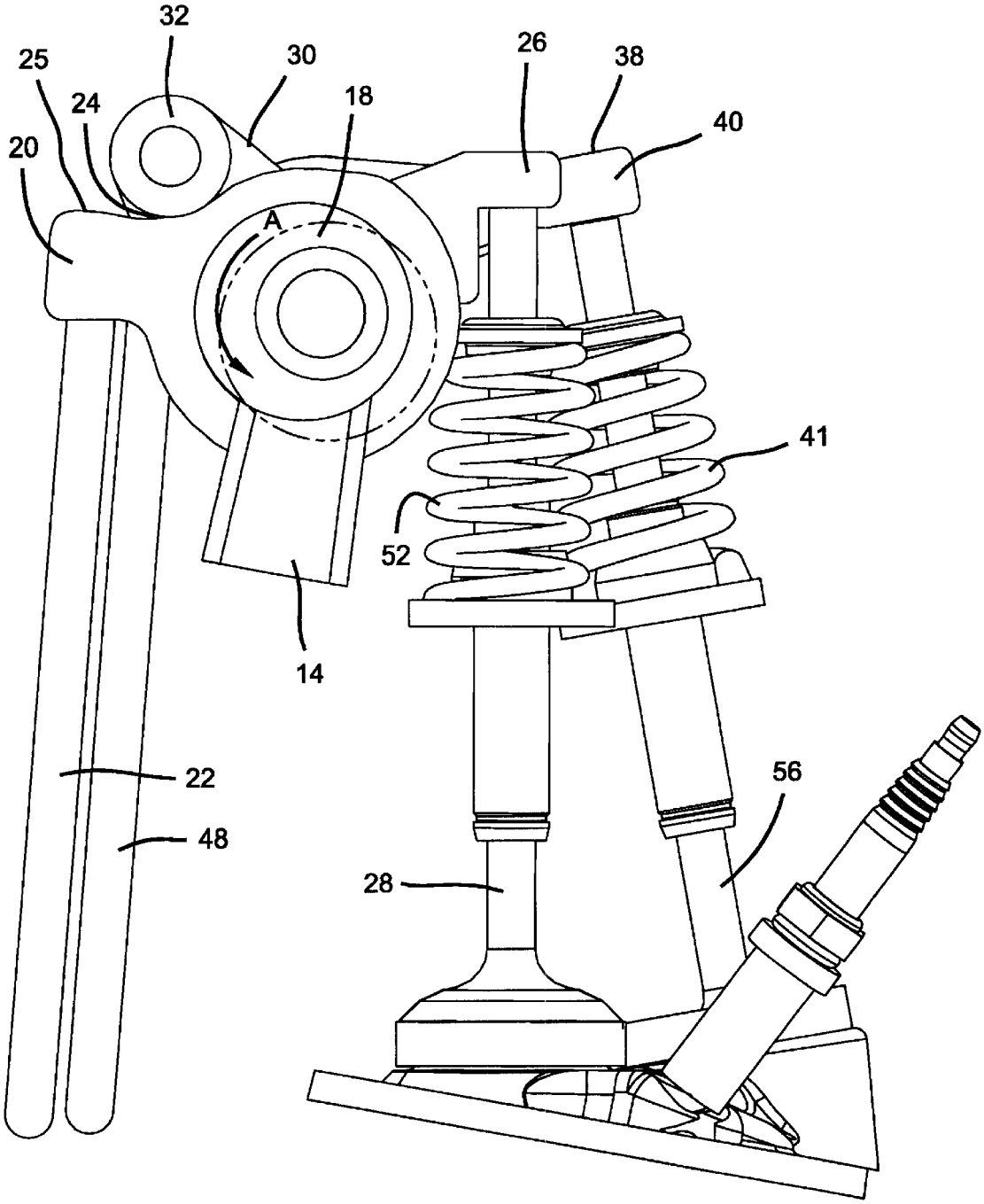
FIG. 3 is an end view of a preferred embodiment of the present invention.

The engaging surface 24 extends from the primary rocker 20 and includes a curved profile 25 for interaction with the roller 32 as best shown in FIG. 3. The curved profile 25 includes a generally arcuate surface disposed at a distal end of the engaging arm 24 and a recess disposed adjacent the arcuate surface. The particular geometry of both the arcuate surface and the recess is governed by the geometry of the eccentric ring 18 such that as the eccentric ring 18 rotates, the roller 32 concurrently moves along the engaging surface 24 to maintain the intake valves 28 in a closed position. Specifically, as the rocker shaft 12 rotates in direction A, as shown in FIG. 3, the primary rocker 20 is caused to shift in a first direction generally away from the cylinder head pedestal 14 due to the eccentric relationship of the axis of rotation of the eccentric cam 18 and the axis of rotation of the rocker shaft 12. As the primary rocker 20 moves sufficiently in the first direction, the roller 32 is caused to move along the curved profile 25 from the recess to the arcuate surface, thereby causing no rotation of the secondary rocker 30, and preventing the rockers 26,34 from lifting from the valve tips.

FIGS. 1 and 2 also illustrate the system 10 including an exhaust rocker 38 positioned generally central between the first valve arm 26 and the second valve arm 34 and including an exhaust valve arm 40. The system 10 further includes an exhaust pushrod 48 in constant driving engagement with a receiving surface (not shown) on the exhaust rocker 38 and an exhaust arm 40 having an exhaust spring 41 mounted thereto for actuating the exhaust valve 56. Lastly, the system 10 includes an actuator assembly 50 in constant rotational engagement with the rocker shaft 12 for bi-directionally rotating the rocker shaft 12. It should be appreciated that the actuator assembly 50 could be a generic phaser, a piston lever mechanism, or any other mechanical device capable of bi-directionally rotating the rocker shaft. It should further be appreciated that while FIGS. 1 and 2 illustrate a single piston application, the system 10 could be adapted to accommodate a conventional multi-piston engine by simply extending the rocker shaft 12 and providing additional single piston configurations thereon. It should further yet be appreciated that while FIGS. 1 and 2 illustrate a three-valve configuration, the system 10 can be adapted to accommodate any number of valve configurations.

Referring now to FIG. 3, the primary rocker 20 is shown in a low-lift mode. When the internal combustion engine is running, the intake 22 and exhaust 48 pushrods stroke in accordance with the rotation of a camshaft (not shown). The intake pushrod 22 strokes, thus rotating the primary rocker 20 in a clockwise direction. The engaging surface 24 of the primary rocker 20 forces the roller 32 and the secondary rocker 30 to also rotate in a clockwise direction. The secondary rocker 30 pivots about an axis approximately central to the rocker shaft 12, forcing the first 26 and second 34 (see in FIGS. 1 and 2) valve arms to depress the first 28 and second 36 (seen in FIGS. 1 and 2) intake valves. Upon further rotation of the camshaft (not shown) the intake valve springs 52 force the secondary rocker 30 upward, and the intake pushrod 22 down, thus, closing the first 28 and second 36 intake valves.

From FIG. 3 it should be appreciated that when the actuator assembly 50 (shown in FIGS. 1 and 2) rotates the rocker shaft 12 in the direction of arrow A, the eccentric ring 18 rotates causing the attitude of the primary rocker 20 to change relative to the secondary 30 and exhaust 38 (shown in FIGS. 1 and 2) rockers, as previously discussed. This change in attitude results in an increase in the depression of the first 28 and second 36 intake valves when the intake pushrod 22 strokes. The engaging surface 24 is such that when the actuator assembly 50 rotates the rocker shaft 12 thus, rotating the eccentric ring 18, the first 28 and second 36 intake valves remain closed due to the interaction of the roller 32 on the curved profile 25, as illustrated in FIG. 3. In a preferred embodiment, the actuator assembly 50 is a piston-lever assembly that rotates the rocker shaft 12 approximately ninety degrees. In another embodiment the actuator assembly 50 is a conventional phaser that rotates the rocker shaft 12 approximately ninety-degrees. It should be appreciated that while the embodiment described herein includes one ninety degree rotational increment of the rocker shaft 12, an embodiment including any degree and number of rotational increments is included within the scope of the present invention.

Changing the attitude of the primary rocker 20 from the low-lift position to the high-lift position, as discussed above, decreases the depression of the first 28 and second 36 intake valves. Decreasing and increasing the intake valve depression decreases the engine emissions at startup and provides more power and efficiency during acceleration. It should be appreciated that while the system 10 described herein includes a two position rocker system 10, systems capable of providing three or more positions are included within the scope of the present invention. It should also be appreciated that the actuator assembly 50 should be configured such that no actuation is required for the base operating condition of the system, i.e, the condition most commonly utilized. In a system having three or more rotational positions the base condition would most likely be a middle position. Lastly, it should be appreciated that while the description contained herein describes the system 10 adapted to a V-style internal combustion engine, the system 10 is also adaptable to an overhead camshaft internal combustion engine by replacing the pushrods with an overhead camshaft.

Accordingly, a simple rocker system that compactly fits within the cylinder head of a V-style or overhead camshaft internal combustion engine and is capable of varying intake valve lift events for increasing engine efficiency and performance characteristics is provided. Furthermore, a single-shaft rocker system capable of varying intake valve lift events via static means without suffering frictional or gyro dynamic energy losses is provided.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A variable compound rocker system for actuating and varying intake valve lift events and actuating exhaust valve lift events of an internal combustion engine, said rocker system comprising:

a rocker shaft;

an eccentric ring non-rotatably attached to said rocker shaft;

a primary rocker rotatably attached to said eccentric ring and having an engaging surface disposed therefrom, said primary rocker adapted to actuate a secondary rocker;

said secondary rocker rotatably attached to said rocker shaft and positioned generally adjacent to said primary rocker;

a roller disposed adjacent to and in direct constant rolling engagement with said engaging surface of said primary rocker, said secondary rocker adapted to actuate a first intake valve; and an actuator assembly in constant rotational engagement with said rocker shaft and adapted to bi-directionally rotate said rocker shaft for changing the attitude of said primary rocker, causing a change in said intake valve lift events.

2. The rocker system of claim 1, wherein said eccentric ring includes a plurality of eccentric rings.

3. The rocker system of claim 2, wherein said eccentric ring is formed as an integral part of said rocker shaft.

4. The rocker system of claim 2, wherein said eccentric ring is separate from and non-rotatably fixed to said rocker shaft by mechanical means.

5. The rocker system of claim 2, wherein said primary rocker includes a plurality of primary rockers.

6. The rocker system of claim 5, wherein said secondary rocker includes a plurality of secondary rockers.

7. The rocker system of claim 6, further comprising an exhaust rocker rotatably attached to said rocker shaft and positioned generally adjacent to said secondary rocker and opposite said primary rocker, said exhaust rocker for actuating an exhaust valve.

8. The rocker system of claim 7, wherein said exhaust rocker includes a plurality of exhaust rockers.

9. The rocker system of claim 8, further including an intake pushrod for actuating said primary rocker and an exhaust pushrod for actuating said exhaust rocker.

10. The rocker system of claim 9, wherein said intake pushrod includes a plurality of intake pushrods and said exhaust pushrod includes a plurality of exhaust pushrods.

11. The rocker system of claim 8, further including an overhead camshaft for actuating said primary rocker and said exhaust rocker.

12. The rocker system of claim 8, wherein said actuator assembly is a conventional phaser.

13. The rocker system of claim 8, wherein said actuator assembly is a piston-lever assembly.

14. The rocker system of claim 1, wherein said secondary rocker is adapted to actuate a second intake valve.

15. An internal combustion engine having multiple cylinders wherein each cylinder has multiple intake valves, said engine comprising:

a variable compound rocker system for actuating and varying the intake valve lift events for the multiple cylinders and actuating the exhaust valve lift events for the multiple cylinders, said rocker system comprising:

a rocker shaft;

an eccentric ring non-rotatably attached to said rocker shaft;

a primary rocker rotatably attached to said eccentric ring and having an engaging surface disposed therefrom, said primary rocker adapted to actuate a secondary rocker;

said secondary rocker rotatably attached to said rocker shaft and positioned generally adjacent to said primary rocker and having a roller disposed therefrom in direct constant rolling engagement with said engaging surface of said primary rocker, said secondary rocker adapted to actuate a first intake valve and a second intake valve; and an actuator assembly in constant rotational engagement with said rocker shaft and adapted to bi-directionally rotate said rocker shaft for changing the attitude of said primary rocker, causing a change in said intake valve lift events.

16. A motor vehicle having a passenger compartment and a powertrain, said motor vehicle comprising:

an internal combustion engine having multiple cylinders wherein each cylinder has multiple intake valves, said engine comprising:

a variable compound rocker system for actuating and varying the intake valve lift events for the multiple cylinders and actuating the exhaust valve lift events for the multiple cylinders, said rocker system comprising:

a rocker shaft;

an eccentric ring non-rotatably attached to said rocker shaft;

a primary rocker rotatably attached to said eccentric ring and having an engaging surface disposed therefrom, said primary rocker adapted to actuate a secondary rocker;

said secondary rocker rotatably attached to said rocker shaft and positioned generally adjacent to said primary rocker and having a roller disposed therefrom in direct constant rolling engagement with said engaging surface of said primary rocker, said secondary rocker adapted to actuate a first intake valve and a second intake valve; and an actuator assembly in constant rotational engagement with said rocker shaft and adapted to bi-directionally rotate said rocker shaft for changing the attitude of said primary rocker, causing a change in said intake valve lift events.

* * * * *